US010724780B2

(12) United States Patent
Yao et al.

(10) Patent No.: US 10,724,780 B2
(45) Date of Patent: Jul. 28, 2020

(54) CRYOCOOLING SYSTEM AND METHOD

(71) Applicant: Advanced Research Systems, Inc., Macungie, PA (US)

(72) Inventors: Shenghong Yao, Macungie, PA (US); Tim Schilling, Coaldale, PA (US)

(73) Assignee: Advanced Research Systems, Inc., Macungie, PA (US)

( * ) Notice: Subject to any disclaimer, the term of this patent is extended or adjusted under 35 U.S.C. 154(b) by 119 days.

(21) Appl. No.: 15/882,518

(22) Filed: Jan. 29, 2018

(65) Prior Publication Data

US 2019/0234672 A1 Aug. 1, 2019

(51) Int. Cl.

*F25D 3/10* (2006.01)
*F25D 25/00* (2006.01)
*F25D 19/00* (2006.01)

(52) U.S. Cl.

CPC ..... *F25D 3/102* (2013.01); *F25D 19/00* (2013.01); *F25D 25/005* (2013.01); *F25D 2300/00* (2013.01); *F25D 2400/28* (2013.01); *F25D 2600/00* (2013.01)

(58) Field of Classification Search

CPC .... F25B 9/145; F25B 9/12; F25B 9/10; F25B 3/102; F25B 19/00; F25B 25/005; F25B 2300/00

See application file for complete search history.

(56) References Cited

U.S. PATENT DOCUMENTS 2,983,714 A 5/1961 Robinson et al.
5,220,800 A 6/1993 Muller et al.
5,317,878 A 6/1994 Bradshaw et al.
5,647,228 A 7/1997 Sager et al.
5,829,270 A * 11/1998 Mikheev ..... F25B 9/10 62/610
7,363,767 B2 4/2008 Wang
(Continued)

FOREIGN PATENT DOCUMENTS

WO 2001096020 A1 12/2001

OTHER PUBLICATIONS

Cryocoolers 17, 1K 4He Close Cycle. Edited by S.D. Miller and R.G. Ross, Jr., International Cryocooler Conference, Inc., Boulder, CO, 2012, pp. 487-494. [Retrieved from the internet] URL: <http://cryocooler.org/proceedings/paper-files/C17papers/061.pdf>.
(Continued)

*Primary Examiner* — Cassey D Bauer
(74) *Attorney, Agent, or Firm* — Design IP

(57) ABSTRACT

The present disclosure relates to a cryocooling system and method. The system includes a sample well and a sample chamber, each of which having an interior that is sized and shaped to hold a cryocooling gas at cryogenic temperatures and a pressure below 1 atm. The sample chamber is also sized and shaped to hold a sample substance to be cryocooled. An impedance tube connects the interior of the sample well to the interior of the sample chamber to allow cryocooling gas to move from the sample well to the sample chamber. A vacuum tube is connected to the interior of the sample chamber on one side and to a vacuum pump via a vacuum port on the other. The vacuum tube is sized and shaped to allow cryocooling gas within the sample chamber to be pumped out of the sample chamber by the vacuum pump.

13 Claims, 14 Drawing Sheets

(56) References Cited

U.S. PATENT DOCUMENTS

| | | | | |
|---|---|---|---|---|
| 7,437,878 | B2 | 10/2008 | Gedeon et al. | |
| 9,134,047 | B2 | 9/2015 | Black et al. | |
| 9,234,691 | B2 | 1/2016 | Black et al. | |
| 2005/0229609 | A1* | 10/2005 | Kirichek | F25B 9/02 62/6 |
| 2009/0224862 | A1* | 9/2009 | Mikheev | H01F 6/04 335/216 |
| 2009/0275476 | A1 | 11/2009 | Atrey | |
| 2010/0281885 | A1* | 11/2010 | Black | F25B 9/10 62/46.1 |
| 2012/0167598 | A1 | 7/2012 | Diederichs et al. | |
| 2014/0202174 | A1 | 7/2014 | Wang | |
| 2014/0202179 | A1* | 7/2014 | Batey | F25D 29/001 62/62 |
| 2015/0143820 | A1 | 5/2015 | Kirichek | |
| 2016/0123537 | A1 | 5/2016 | Heiss et al. | |
| 2016/0178247 | A1 | 6/2016 | Waele et al. | |

OTHER PUBLICATIONS

Cryomech Co., 1K Cryostat. Jul. 11, 2014. [Retrieved from the internet] URL: <http://www.cryomech.com/cryostats/1k-cryostat/>.

Arxiv, Evanescent straight tapered-fiber coupling of ultra-high Q optomechanicalmicro-resonators. May 20, 2013, pp. 1-8. [Retrieved from the internet] URL: <http://arxiv.org/abs/1305.4504v1>.

Janis, Cryocooler System. Sep. 9, 2014. [Retrieved from the internet] URL: <http://www.janis.com/RecirculatingHeliumGasSystem_IOP.aspx>.

Cryogenics, A three-stage Stirling pulse tube cryocooler operating. vol. 51, Issue 10, Oct. 2011, pp. 609-612. [Retrieved from the internet] URL: <http://www.sciencedirect.com/science/article/pii/S0011227511001470>.

Oxford Instruments, Closed cycle optical cryostat 4 K, OptistatAC-V12. [Retrieved from the internet] URL: <https://www.oxford-instruments.com/products/cryogenic-environments/optical-cryostats-for-spectroscopy/closed-cycle-cryostats/4k-closed-cycle-optical-cryostat-sample-in-vacuum>.

Oxford Instruments, Closed cycle optical cryostat 1.5 K or 4 K, OptistatPT. [Retrieved from the internet] URL: <https://www.oxford-instruments.com/products/cryogenic-environments/optical-cryostats-for-spectroscopy/closed-cycle-cryostats/1-5-k-to-4-k-closed-cycle-optical-cryostat-optista>.

Cryogenics, Ultimate temperature of pulse tube cryocoolers. Cryogenic Engineering Conference—CEC, vol. 55, edited by J.G. Weisend II. Oct. 26, 2016. [Retrieved from the internet] URL: <http://scitation.aip.org/docserver/fulltext/aip/proceeding/aipcp/flat/10.1063/1.3422342/1.3422342.pdf? expires=1477455994&id=id&accname=guest&checksum=D653DE9394EA0995CA107889FBC3557B>.

Cryogenics, Proposed designs for a "dry" dilution refrigerator with a 1K condenser. Cryogenics 49(7), pp. 371-375. Jul. 2009. [Retrieved from the internet] URL: <https://www.researchgate.net/publication/222422942_Proposed_designs_for a_dry_dilution_refrigerator_with_a_1K_condenser>.

* cited by examiner

CRYOCOOLING SYSTEM AND METHOD

BACKGROUND

Helium is a well-known gas used in cryocooling systems. Helium comes in two different isotopes: helium-3 ($^3$He) and helium-4 ($^4$He). Because of their low boiling points (3.19 K at 1 atm for helium-3; 4.22 K at 1 atm for helium-4), the helium isotopes are well suited for a wide range of low temperature applications where gas is the desired cooling medium. Of the two helium isotopes, helium-4 is the more commonly available isotope, making it the less expensive and more attractive isotope for cryocooling systems.

However, using helium-4 has a drawback: cooling helium-4 below its Lambda point (2.17 K for $^4$He) results in a phase change from a classical liquid state to a "superfluid" state. Superfluids are notable for the fact that they exhibit zero viscosity and have infinite thermal conductivity. These properties of superfluid helium-4 can be undesirable for cryocooling systems for a number of reasons. For instance, most cryocooling systems have two chamber systems that require restrictions in the mass flow rate of a fluid from one chamber to another in order to create pressure differences between two different chambers. If there is no viscosity in the fluid, there is no practical way to restrict mass flow rates to create the required pressure drops. Furthermore, a helium fluid having infinite thermal conductivity means that the temperature of the volume of fluid is practically uniform, making it particularly difficult to reduce its temperature below the critical temperature (i.e., it's Lambda point).

Current cryocooling systems that use helium-4 as the cooling medium are able to achieve temperatures as low as 1.7 K by reducing the pressure of the helium-4. However, such systems have difficulty achieving such low temperatures for long periods of time (e.g., greater than 60 minutes) without inducing a phase change in the helium-4 into a super fluid. By contrast, Helium-3 does not have a known Lambda point (it is believed to be as low as 2.5 mK), and thus does not present a superfluid issue. Having such properties, helium-3 has been a popular medium for cryocooling applications that require temperatures below 1.7 K.

Unfortunately, helium-3 is very rare. Sources of natural gas that contain helium-3 are limited, and atmospheric helium migrates into space and is lost. Because helium-3 is such a limited resource and its demand for use in cryocooling applications has increased dramatically, the cost of helium-3 has also increased dramatically. Accordingly, there is a need for a cryocooling system that is capable of maintaining temperatures at or below 1.7 K in a sample chamber for an extended period of time without having to use helium-3.

SUMMARY

In view of the foregoing background, a cryocooling system is disclosed. The system includes a sample well and a sample chamber, each of which defining an internal volume that is sized and shaped to hold a cryocooling gas, such as helium-4, at cryogenic temperatures and a pressure below 1 atm. The sample chamber is also sized and shaped to hold a sample substance to be cryocooled. An impedance tube with a first and second end connects the interior of the sample well to the interior of the sample chamber to allow cryocooling gas to move from the sample well to the sample chamber. A vacuum tube is connected to the interior of the sample chamber at a first end and to a vacuum pump via a vacuum port at a second end. The vacuum tube is sized and shaped to allow cryocooling gas within the sample chamber to be pumped out of the sample chamber by the vacuum pump.

In one aspect of the invention, the impedance tube has a first hydraulic resistance and the vacuum tube has a second hydraulic resistance, wherein the first hydraulic resistance is higher than the second hydraulic resistance. In one embodiment, the ratio of the first hydraulic resistance to the second hydraulic resistance is between 40:1 and 50:1.

In another aspect, the sample chamber is nested within the sample well. In one embodiment, the vacuum tube has an outer surface, and the impedance tube is coiled around the outer surface of the vacuum tube to conserve space inside the sample well and increase the hydraulic resistance of the impedance tube.

In another aspect, the cryocooling system includes a controller that is configured to isolate the internal volumes of the sample well and sample chamber from a supply of cryocooling gas after the cryocooling gas inside the sample chamber has reached a first temperature, and open the vacuum port and activate the vacuum pump when the cryocooling gas inside the sample chamber has reached a second temperature, wherein the second temperature is lower than the first temperature.

In another aspect, the sample well and sample chamber are held in shrouds that hold the sample well and sample chamber in a vacuum. In one embodiment, the sample chamber includes a sample plate made from copper that holds a sample substance outside of the sample chamber and in the shroud's vacuum.

In another aspect, the cryocooling system includes a return gas tube that is in fluid-flow communication with the sample well so as to recycle exhausted cryocooling gas back into the cryocooling system.

A method of cryocooling is also disclosed using the cryocooling system discussed above. The method uses the system discussed above and comprises introducing a cryocooling gas into the sample well and the sample chamber via the gas inlet valve; activating the cryocooler to cool the cryocooling gas in the sample well and the sample chamber; closing the gas inlet valve when a temperature of the cryocooling gas in the sample chamber has reached a first cryogenic temperature; opening the vacuum port when the temperature of the cryocooling gas in the sample chamber has reached a second cryogenic temperature; and withdrawing cryocooling gas from the sample chamber through the vacuum tube to cause the temperature of the cryocooling gas in the sample chamber to fall below a third cryogenic temperature, wherein the third cryogenic temperature is lower than the second cryogenic temperature, and the second cryogenic temperature is lower than the first cryogenic temperature.

In one aspect of the invention, the method includes inserting a sample to be cooled in the sample chamber.

In another aspect, the third cryogenic temperature is less than or equal to 1.50 kelvin. In one embodiment, the sample chamber is held at a temperature below 1.50 kelvin for over two hours, and more preferably, over three hours.

In another aspect, the method includes evacuating or purging the sample well and sample chamber of air by withdrawing the air through the vacuum tube either before or during introduction of the cryocooling gas to the system.

In another aspect, the method includes feeding exhausted cryocooling gas into the sample well via a return gas tube, wherein the exhausted cryocooling gas comprises cryocooling gas that was removed from the sample chamber during the selectively withdrawing step.

An additional method of cryocooling is also disclosed using the cryocooling system discussed above. The method includes (a) providing a cryocooling system including a sample well, a sample chamber, an impedance tube in fluid-flow communication with the sample well and the sample chamber, and a vacuum tube in fluid-flow communication with the sample chamber, the impedance tube having a hydraulic resistance that is higher than a hydraulic resistance of the vacuum tube; (b) purging the sample well and sample chamber of all gas except a cryocooling gas; (c) cooling the cryocooling gas in the sample well and sample chamber via indirect heat exchange; (d) reducing the pressure of the cryocooling gas in the sample chamber using a vacuum to create a pressure difference between the cryocooling gas in the sample well and the cryocooling gas in the sample chamber; (e) allowing liquid phase cryocooling gas to accumulate in the sample well prior to step (d); (f) isolating the sample well and sample chamber from a cryocooling gas supply prior to step (d); and (g) performing step (d) until the cryocooling gas in the sample chamber attains a temperature at or below 3.5 Kelvin. In one aspect of the invention, the method further includes (h) supplying the sample well and sample chamber with the cryocooling gas from the cryocooling gas supply prior to step (f). In another aspect, step (d) further includes withdrawing cryocooling gas from the sample chamber through the vacuum tube.

BRIEF DESCRIPTION OF THE DRAWINGS

For a more complete understanding of the present invention, reference is made to the following detailed description of an embodiment considered in conjunction with the accompanying drawings, in which.

DETAILED DESCRIPTION OF THE INVENTION

Figure 1:
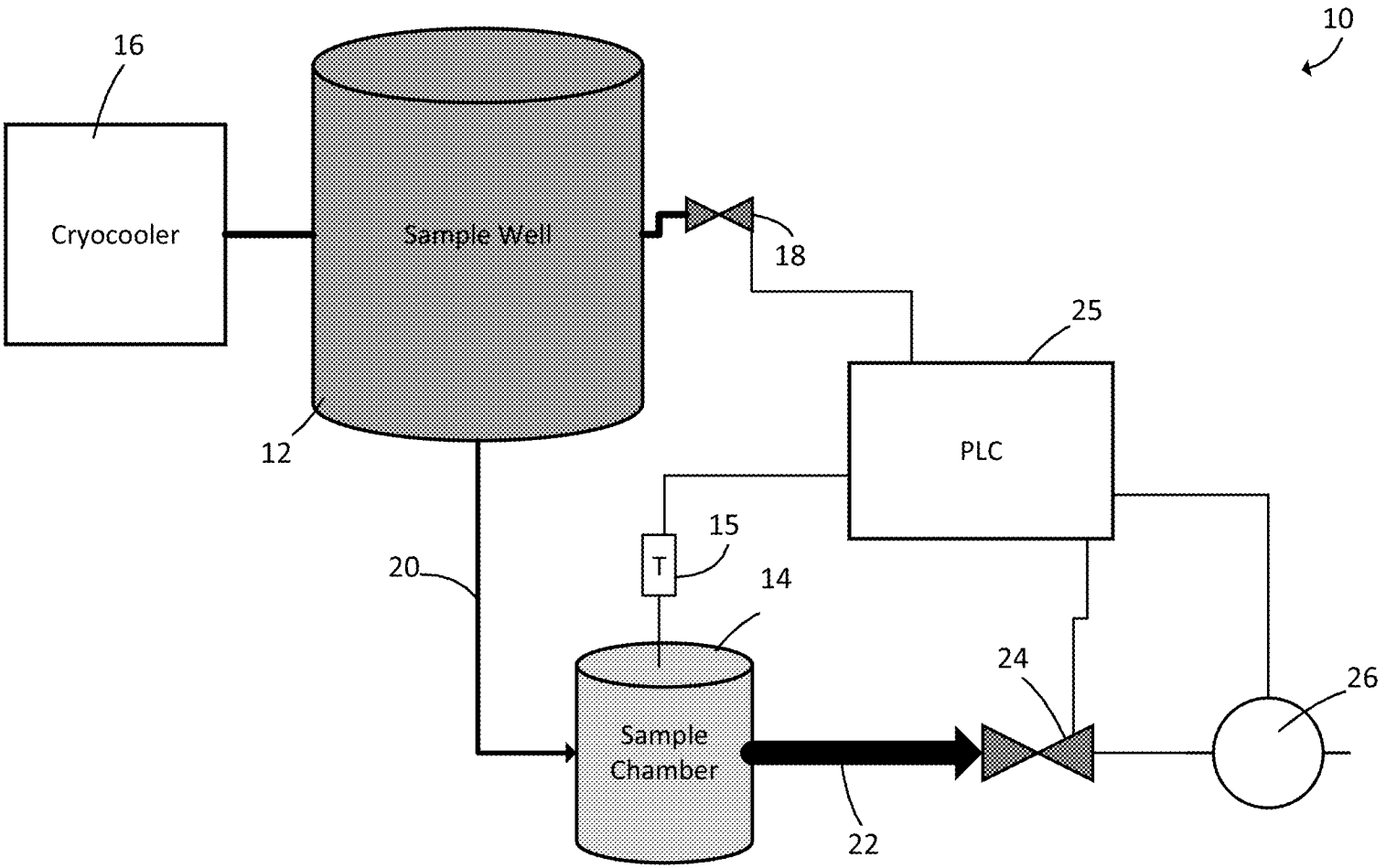
FIG. 1 is a block diagram schematically showing the elements of a cryocooling system constructed in accordance with a first exemplary embodiment.

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign particular meaning. Further, it should be noted that, as recited in the specification and in the claims appended hereto, the singular forms "a," "an," and "the" include the plural referents unless otherwise stated. Additionally, the terms "comprises" and "comprising" when used herein specify that certain features are present in that embodiment, but should not be interpreted to preclude the presence or addition of additional features, components, operations, and/or groups thereof.

The following disclosure is intended to be read in connection with the accompanying drawings, which are to be considered part of the entire written description of the invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such an attachment, coupling, or connection that allows the pertinent structures to operate as intended by virtue of that relationship.

Referring to FIG. 1, a block diagram schematically illustrating the principle elements of a cryocooling system 10 is shown. The cryocooling system 10 includes a sample well 12 and a sample chamber 14, each of which defining an internal volume that is sized, shaped, and configured to hold a cryocooling gas, namely helium-4, at cryogenic temperatures (i.e., 78K or less) and at pressures much less than 1 atm (i.e., in a vacuum). The sample well 12 is in thermal communication with a cryocooler 16 that is configured to lower the temperature of any gas in the sample well 12 to cryogenic temperatures. A gas inlet valve 18 is attached to and in fluid-flow communication with the sample well 12 to allow for the introduction of gas prior to and during operation of the cryocooling system 10.

An impedance tube 20 is connected to and in fluid flow communication with the sample well 12 and the sample chamber 14 such that gas can flow from the sample well 12 to the sample chamber 14. A vacuum tube 22 is connected to and in fluid-flow communication with the sample chamber 14 and ends at a vacuum port 24, which is connected to a vacuum pump 26 to allow for the removal of gas from the sample chamber 14. In one embodiment, a temperature gauge 15 is connected to the sample chamber 14 to measure the temperature of the gas inside the sample chamber 14.

The impedance tube 20 has a length $L_1$, a cross-sectional radius $R_1$, and a hydraulic resistance $R_{h1}$ that is a function of its length L and radius R (i.e., $R_h=(8\ \mu L)/(\pi R^4)$, where μ is the coefficient of friction). Likewise, the vacuum tube 22 has a length $L_2$, a cross-sectional radius $R_2$, and a hydraulic resistance $R_{h2}$. The impedance tube 20 is sized and shaped to have a higher hydraulic resistance to gas flow than that of the vacuum tube 22 (i.e., $R_{h1}>R_{h2}$), thereby ensuring that the flow of gas from the sample well 12 to the sample chamber 14 is slower than the flow of gas leaving the sample chamber 14. This allows the cryocooling system 10 to create a lower gaseous pressure in the sample chamber 14 compared to the gaseous pressure in the sample well 12 when the vacuum pump 26 is turned on. In one embodiment, the impedance tube 20 achieves this increased hydraulic resistance by being considerably longer and narrower than the vacuum tube 22. Preferably, the ratio between the hydraulic resistance $R_{h1}$ of the impedance tube 20 to the hydraulic resistance $R_{h2}$ of the vacuum tube 22 is between 40:1 and 50:1.

In one embodiment, the gas inlet valve 18, vacuum port 24, vacuum pump 26, and temperature gauge 15 are all operated and read manually. In another embodiment, the gas inlet valve 18, vacuum port 24, vacuum pump 26, and temperature gauge 15 are connected to a controller 25 that is configured to measure the temperature of the sample chamber 14, control the opening and closing of the gas inlet valve 18 to regulate the influx of fresh helium-4 into the sample well 12, and control operation of the vacuum pump 26 and vacuum port 24, all in accordance with a cryocooling method discussed further below. Preferably, the controller 25 is a programmable logic controller that is able to automatically control operation of the gas inlet valve 18, vacuum pump 26, and vacuum port 24 based on the values it receives from the temperature gauge 15.

Figure 2:
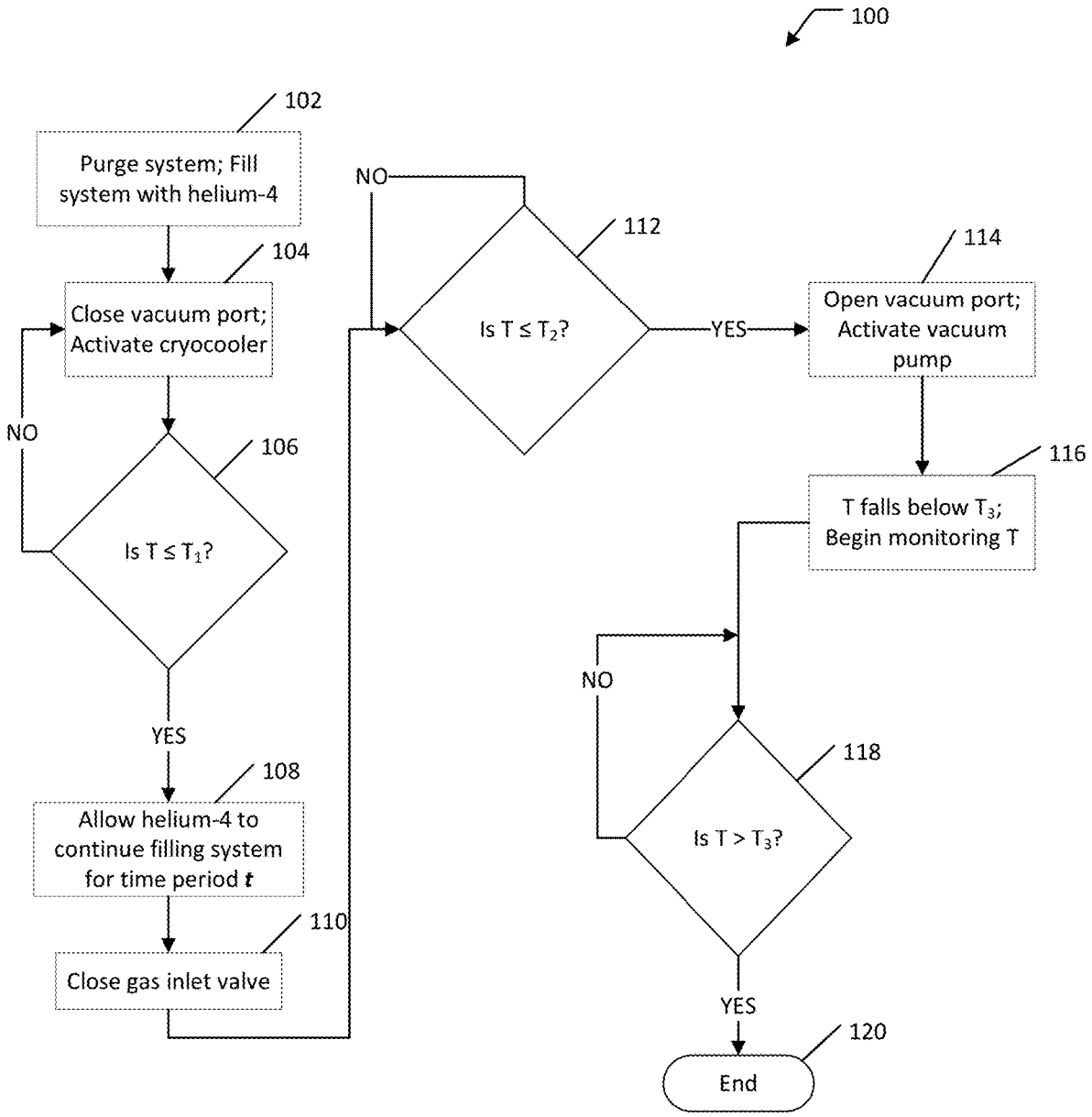
FIG. 2 is a flow chart illustrating a method of operating the cryocooling system of FIG. 1.

FIG. 2 illustrates the operation of a cryocooling method 100 using the cryocooling system 10 shown in FIG. 1. The method 100 begins with purging of the cryocooling system 10 of air while also introducing the cryocooling system 10 with helium-4 (step 102). This is accomplished by opening the vacuum port 24 and activating the vacuum pump 26 to evacuate the sample well 12 and sample chamber 14 of any air trapped therein while feeding helium-4 to the sample well 12 through the gas inlet valve 18. The purge and fill step 102 continues until only helium-4 occupies the inside of the sample well 12 and sample chamber 14. At this time, the vacuum port 24 is closed and the cryocooler 16 is activated to begin cooling the helium-4 inside the sample well 12 (step 104).

Helium-4 is continually fed through the gas inlet valve 18 and cooled by the cryocooler 16 until the temperature of the helium-4 inside the sample chamber 14 reaches a first cryogenic temperature $T_1$ at atmospheric pressure (step 106). In one embodiment, the first cryogenic temperature $T_1$ is approximately 4.22 K, which is the temperature of liquid helium-4 at atmospheric pressure (i.e., 1 atm).

At this point, helium-4 is further fed through the gas inlet valve 18 for a predetermined time period t to allow liquid helium-4 to accumulate inside the sample well 12 (step 108). In one embodiment, this time period t is approximately one hour; in other embodiments, the time period t can be longer to collect greater amounts of liquid helium-4. The amount of liquid helium-4 collected will determine how long later stages of the cryocooling method 100 will last, as explained further below.

Once the predetermined time t has elapsed and the liquid helium-4 has been collected inside the sample well 12 and sample chamber 14, the gas inlet valve 18 is closed (step 110) while the cryocooler 16 continues to run. This allows the helium-4 inside the sample chamber 14 to continue to cool to a second cryogenic temperature $T_2$ (step 112). The value of $T_2$ will depend on the capacity of cryocooler 16 to reach cryogenic temperatures, as well as the size of the sample well 12 and sample chamber 14. In one embodiment, $T_2$ is between 3-3.5 K, causing the pressure of the helium-4 in the sample chamber 14 to be between 200-350 torr.

At this point, the vacuum port 24 is opened and the vacuum pump 26 is reactivated (step 114). The vacuum pump 26 begins removing gaseous helium-4 from the sample chamber, causing the pressure inside of the sample chamber 14 to drop considerably, which in turn causes the helium-4 to drop in temperature below a third cryogenic temperature $T_3$. The value of $T_3$ is equal to the desired upper limit for the cryogenic temperature of the sample chamber 14 and is typically between 1.0 K and 2.2 K. In one embodiment, the third cryogenic temperature $T_3$ is 1.5 K. In other embodiments, $T_3$ is 1.3 K or lower.

As more and more gaseous helium-4 is removed from the sample chamber 14, the pressure differential between the helium-4 inside the sample chamber 14 and the atmosphere outside the vacuum pump 26 becomes greater and greater, until the force of the vacuum pump 26 and the opposing vacuum force of the helium-4 inside the sample chamber 14 becomes equal. During this process, liquid helium-4 that has collected in the sample well 12 and sample chamber 14 begins to vaporize, thereby increasing the amount of gaseous helium-4 inside the sample chamber 14, which in turn increases the pressure inside the sample chamber 14. However, this increase in pressure is counterbalanced by the force of the vacuum pump 26, which removes the additional gaseous helium-4 from the sample chamber 14. Thus, the work of the vacuum pump 26 creates an equilibrium resulting in the amount of gaseous mass of helium-4 inside the sample chamber 14, along with its pressure and temperature, becoming effectively stable. This allows the temperature inside the sample chamber 14 to remain at or below $T_3$ for long periods of time.

In such circumstances, once the temperature of the sample chamber 14 falls below $T_3$, the sample chamber is continually monitored to determine whether its temperature rises above $T_3$ (step 116). Once the temperature of the sample chamber 14 rises above $T_3$ (step 118), it indicates that the amount of collected liquid helium-4 inside the sample well 12 and the sample chamber 14 has completely vaporized and the temperature inside the sample chamber 14 is not going below $T_3$ again. In such circumstances, the cryocooling method 100 ends (step 120).

The goal of the cryocooling method 100 is to achieve the lowest temperature possible inside the sample chamber 14 for the longest period of time possible. The lowest temperature achievable by the cryocooling method 100 depends on how powerful the vacuum pump 26 is, with more powerful vacuum pumps yielding lower gaseous pressure values, thereby yielding lower temperature values. The time period at which the lowest temperature can be maintained depends on how much liquid helium-4 has been collected in the sample well 12 and the sample chamber 14 during step 108.

The function of the impedance tube 20 in this process is to slow the influx of helium-4 into the sample chamber 14 from the sample well 12 while gas is being removed via the vacuum pump 26 through the vacuum tube 22. This helps maintain the pressure of the helium-4 inside the sample chamber and extend the time in which the temperature inside the sample chamber 14 is at or below $T_3$.

Another function of the impedance tube 20 is to control the location of where helium-4 inside the sample well 12 enters the sample chamber 14. The helium-4 inside the sample well 12 has a moderate vertical temperature gradient, with helium-4 near the top of the sample well 12 having a slightly higher temperature than the helium-4 near the bottom of the sample well 12. Since the lower temperature helium-4 tends to be liquid and the higher temperature helium-4 tends to be gaseous, positioning the intake portion of the impedance tube 20 in the upper portion of the sample well 12 ensures that only gaseous helium-4 travels from the sample well 12 to the sample chamber 14. This is to keep the pressure in the sample well 12 steady, as liquid helium-4 at the bottom of the sample well 12 provides the gaseous helium-4 by vaporizing at constant pressure.

FIGS. 3-6 and 7-9 illustrate first and second embodiments, respectively, of the cryocooling system 10 discussed above and illustrated in FIG. 1. The elements illustrated in FIGS. 3-5 and 7-9, which correspond to the elements described above with respect to the diagram shown in FIG. 1, have been designated by corresponding reference numbers increased by one hundred and two hundred, respectively. Any element referenced below and identified in the attached drawings should be assumed as having the same or similar structure and function as its corresponding element shown in previous figures, except where specifically indicated otherwise below.

Figure 3:
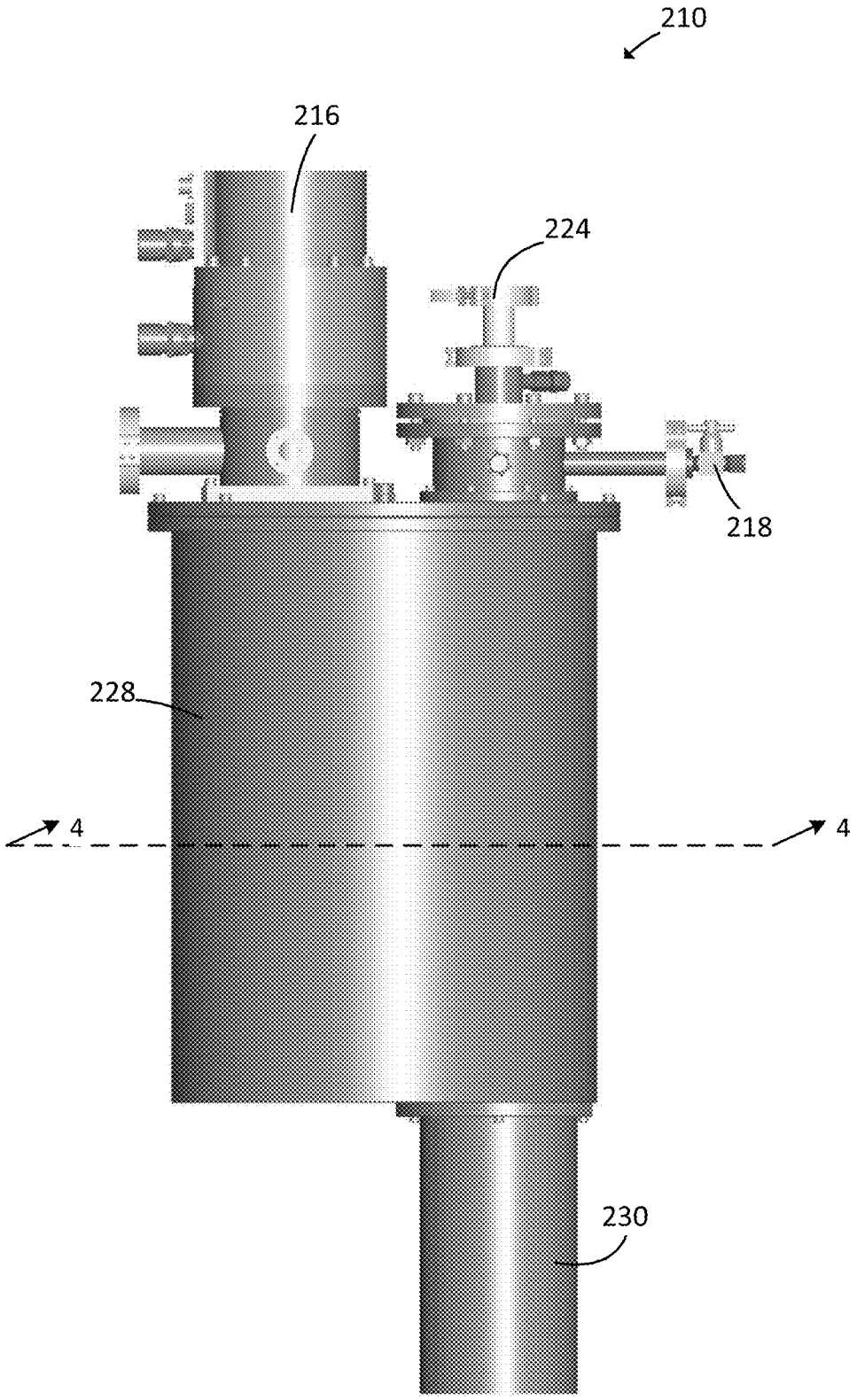
FIG. 3 is an elevational view of a cryocooling system constructed in accordance with the first embodiment shown in FIG. 1.
Figure 4:
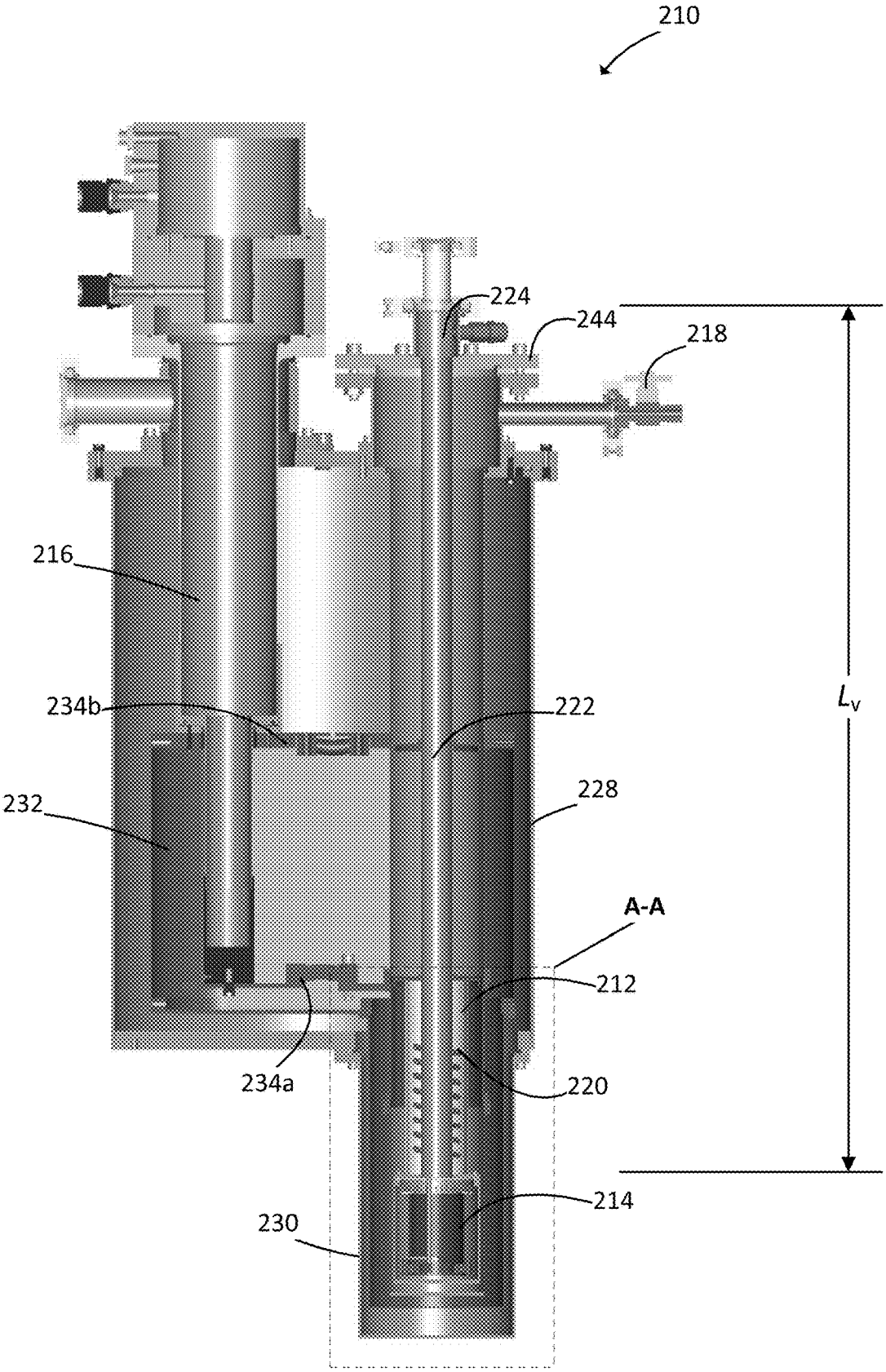
FIG. 4 is a sectional view taken along line 4-4 of FIG. 3.
Figure 5:
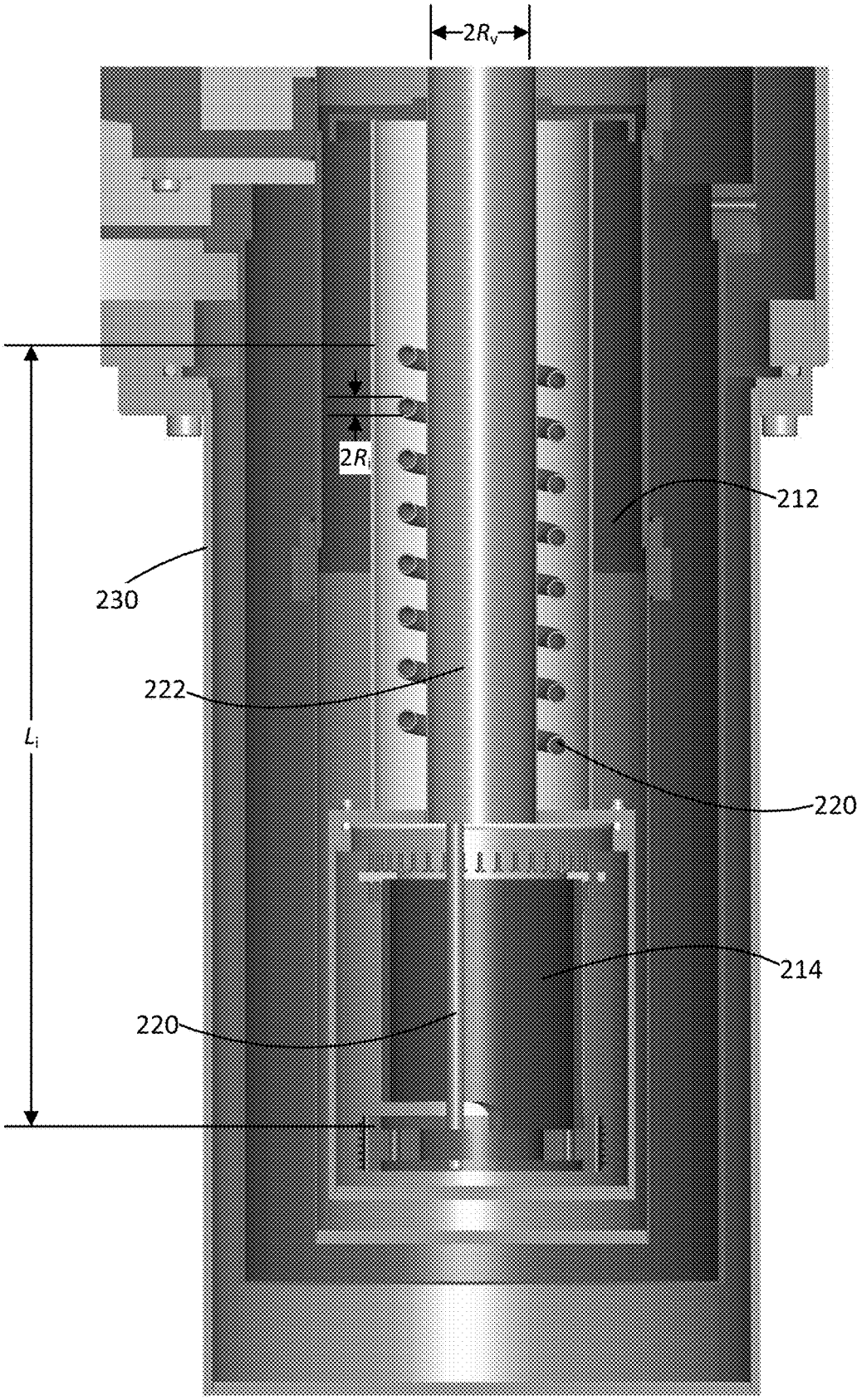
FIG. 5 is an enlarged partial view of area A-A of FIG. 4.

FIGS. 3-5 show one embodiment of a cryocooling system 210 capable of performing the cryocooling method 100 discussed above. The cryocooling system 210 includes a vacuum shroud (i.e., upper shroud 228 and lower shroud 230) that encases the cryocooler 216, the sample well 212, and the sample chamber 214 within a vacuum and is equipped with a radiation shield 232 that prevents light and other outside sources of energy from affecting the temperature of the parts therein. The cryocooler 216 is a standard two-stage cryocooler well known in the art and is connected to the sample well 212 via first and second heat exchangers 234*a*, 234*b* which correspond to the first and second stages of the cryocooler 216 and allow for the transfer of energy from the gas inside the sample well 212 to the cryocooler 216. In one embodiment, the cryocooler 216 has a first stage that can reach 20 K and a second stage that can reach 2.5 K. The sample chamber 214 is positioned below and away from the cryocooler 216.

As seen in FIGS. 4 and 5, the cryocooling system 200 is designed to be a compact, space-saving embodiment of the cryocooling system 10 shown in FIG. 1. As such, the sample chamber 214 of the cryocooling system 200 is nested within the sample well 212, and the vacuum tube 222 runs from the sample chamber 214 up through the sample well 212 and all the way to the top of the upper shroud 228, where the vacuum port 224 is located. The gas inlet valve 218 is located proximate to the vacuum port 224, which allows a user to operate both from one location.

Figure 6:
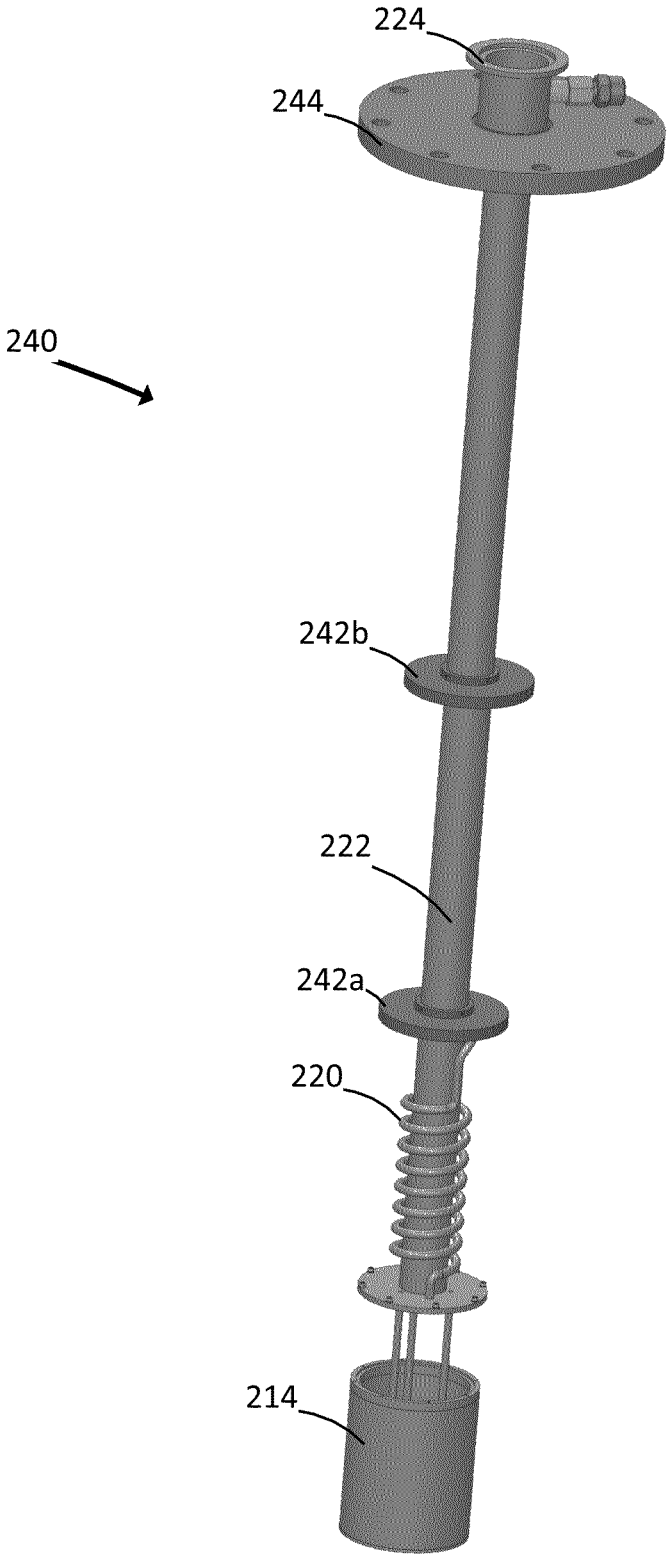
FIG. 6 is an exploded perspective view of a sample stick from the cryocooling system shown in FIGS. 3-5.

As seen in FIG. 6, in one embodiment, the sample chamber 214, the impedance tube 220, and the vacuum tube 222 are part of a sample stick 240 that can be inserted into the sample well 212. The sample chamber 214 is attached to the end of the vacuum tube 222 that includes several conduction rings (i.e., conduction rings 242*a*, 242*b*) located along the length of the vacuum tube 222 and has a sample stick cap 244 just below the vacuum port 224 that closes off and seals the top of the sample well 212. The conduction rings 242*a*, 242*b* are located at points along the length of the vacuum tube 222 that correspond to the position of the first and second heat exchangers 234*a*, 234*b* connected to the cryocooler 216 to assist the cryocooler 216 in cooling the cryocooling gas in the sample well 212. Because the length of the vacuum tube 222 extends beyond the height of the upper shroud 228, the portion of the impedance tube 220 that receives gas from the sample well 212 is similarly long in order to maintain its higher hydraulic resistance. This portion of the impedance tube 220 is wrapped around the vacuum tube 222 to conserve space inside the sample well 212.

As seen in FIGS. 4 and 5, the impedance tube 220 has a length of $L_i$ and a diameter of $2R_i$, while the vacuum tube 222 has a length of $L_v$ and a diameter of $2R_v$. In one embodiment, the impedance tube 220 and vacuum tube 222 are made from stainless steel, with the impedance tube 220 having a length of 37 inches ($L_i$=37 in), a diameter of 3/16 inch (Ri=3/32 in), and a wall thickness of approximately 0.020 inches, and the vacuum tube 222 having a length of 26.25 inches ($L_v$=26.25 in), a diameter of 1 inch ($R_v$=0.5 in), and a wall thickness of 0.016 inches.

Figure 7:
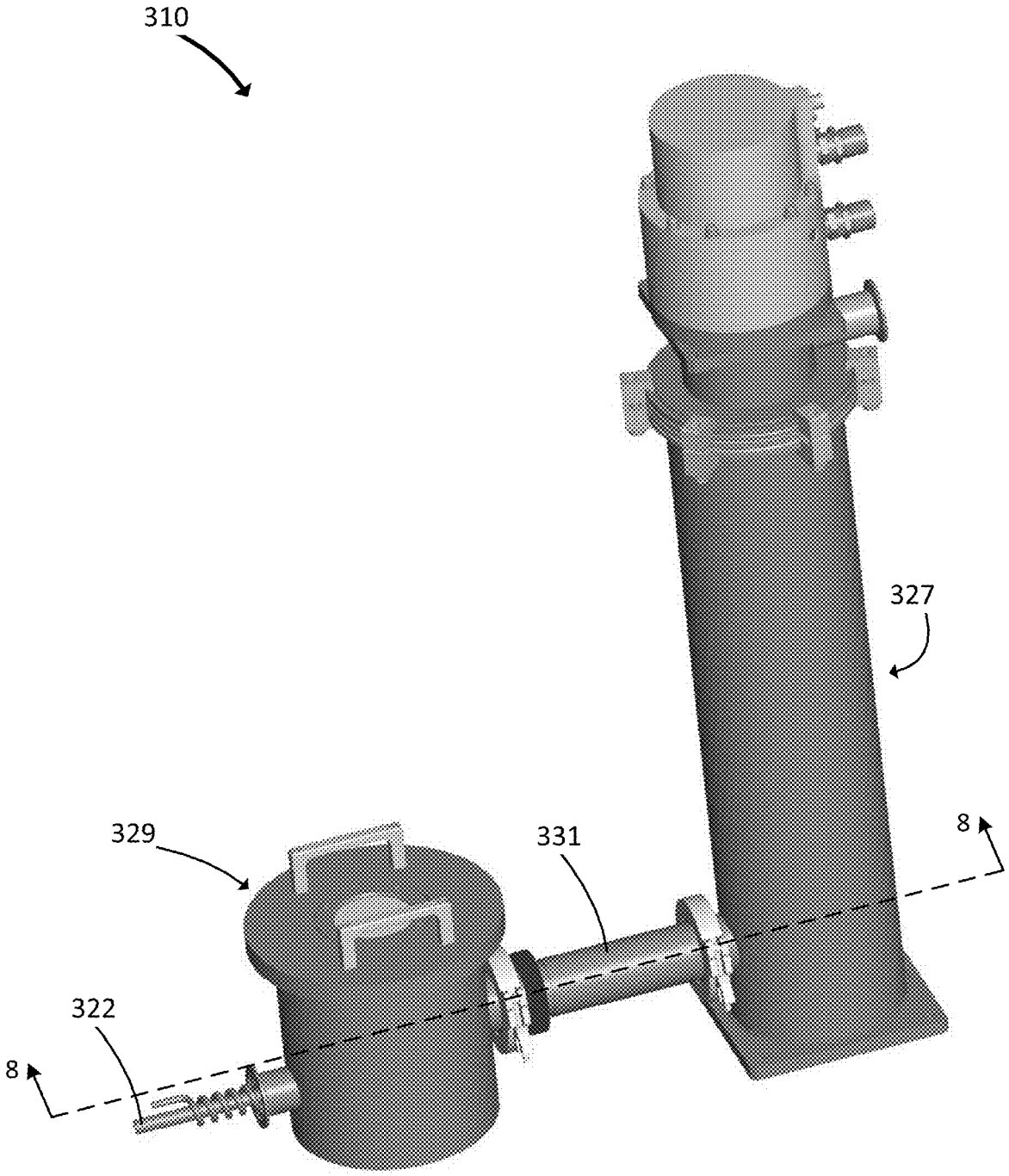
FIG. 7 is a perspective view of a second exemplary embodiment of a cryocooling system.
Figure 8:
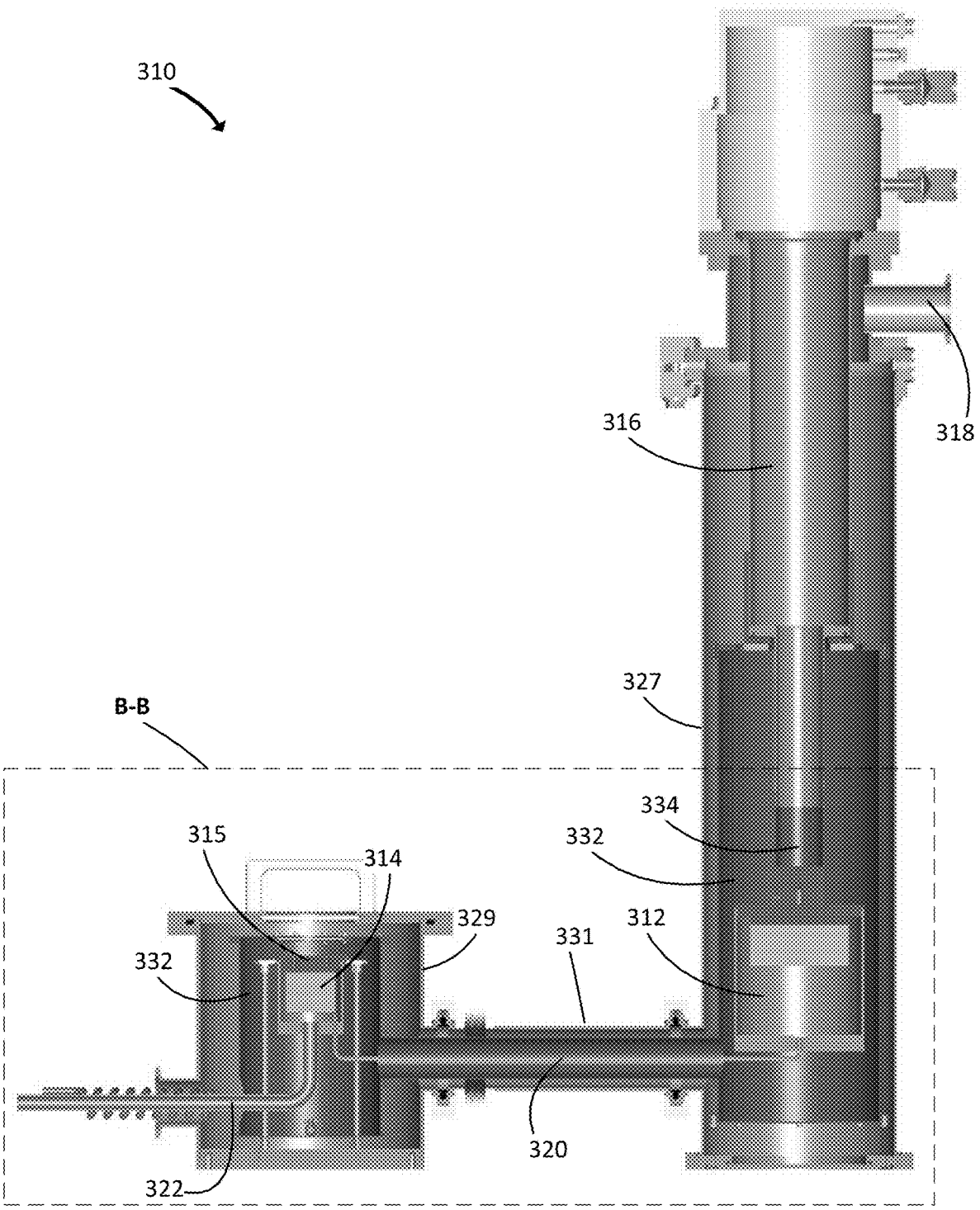
FIG. 8 is a sectional view taken along line 8-8 of FIG. 7.
Figure 9:
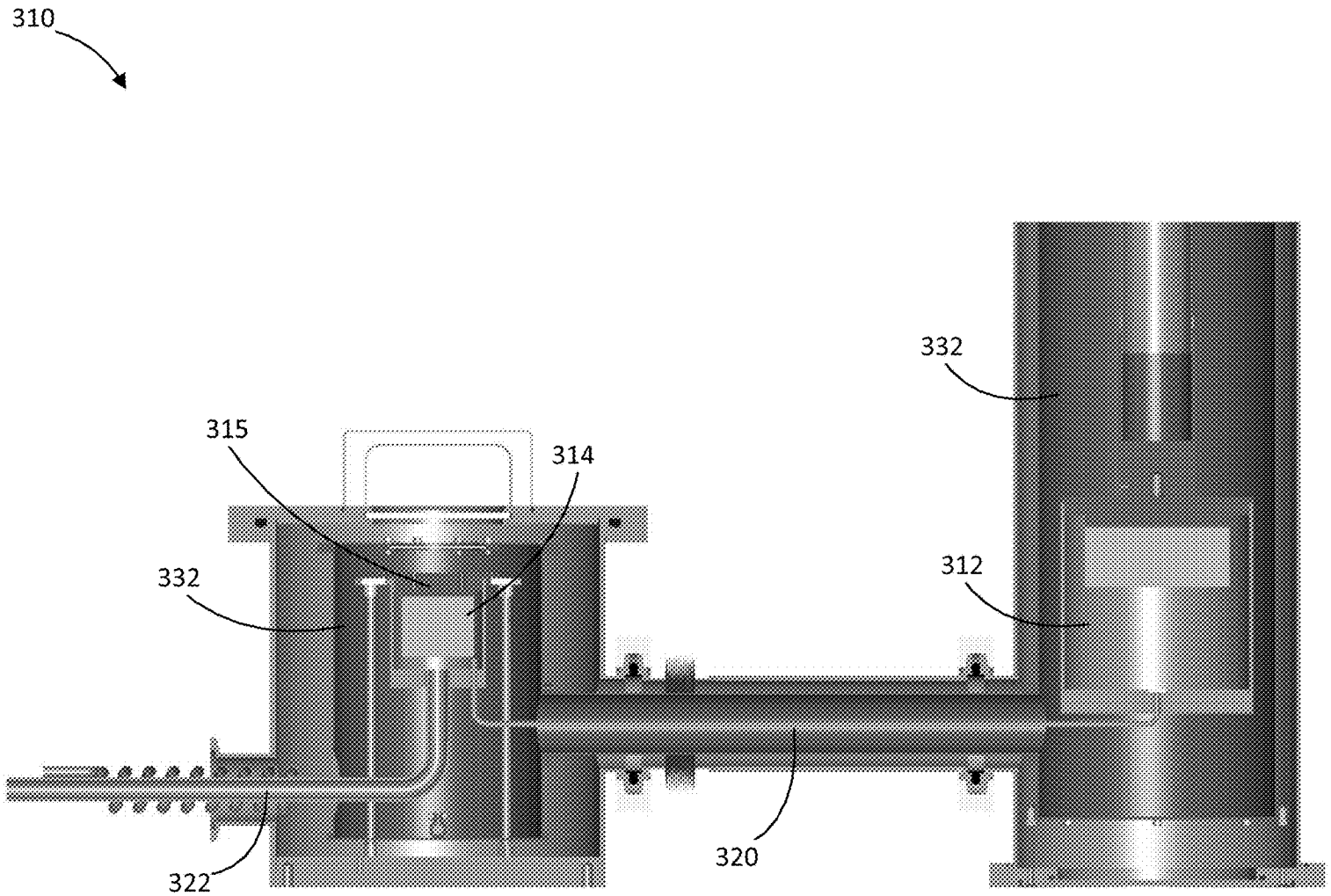
FIG. 9 is an enlarged partial view of area B-B of FIG. 8.

FIGS. 7-9 illustrate a second embodiment of a cryocooling system 310 configured to perform the cryocooling method 100 shown in FIG. 2. In this embodiment, the sample well 312 and the sample chamber 314 are located in separates shrouds (i.e., the sample well shroud 327 and the sample chamber shroud 329) and connected by a tubular shroud 331 that houses a portion of the impedance tube 320 connecting the sample well 312 to the sample chamber 314. In addition, the sample chamber 314 includes a sample plate 315 located at the top of the sample chamber 314 upon which the sample which is to be cooled may sit. In this manner, the cryocooled gas inside the sample chamber 314 is able to cool the sample through the sample plate 315. This allows the sample to be placed in a vacuum space within the radiation shield 332 while being cooled through the sample plate 315.

As a result of not being nested within the sample well 312, the sample chamber 314 is able to be placed in a vacuum within the sample chamber shroud 329. This arrangement allows for better control over the environment of the sample chamber 314 compared to the vapor environment of the sample chamber 214 shown in FIGS. 3-5, allowing for the sample chamber 314 to reach temperatures of 1.5 kelvin or less over a duration of several hours.

Figure 10:
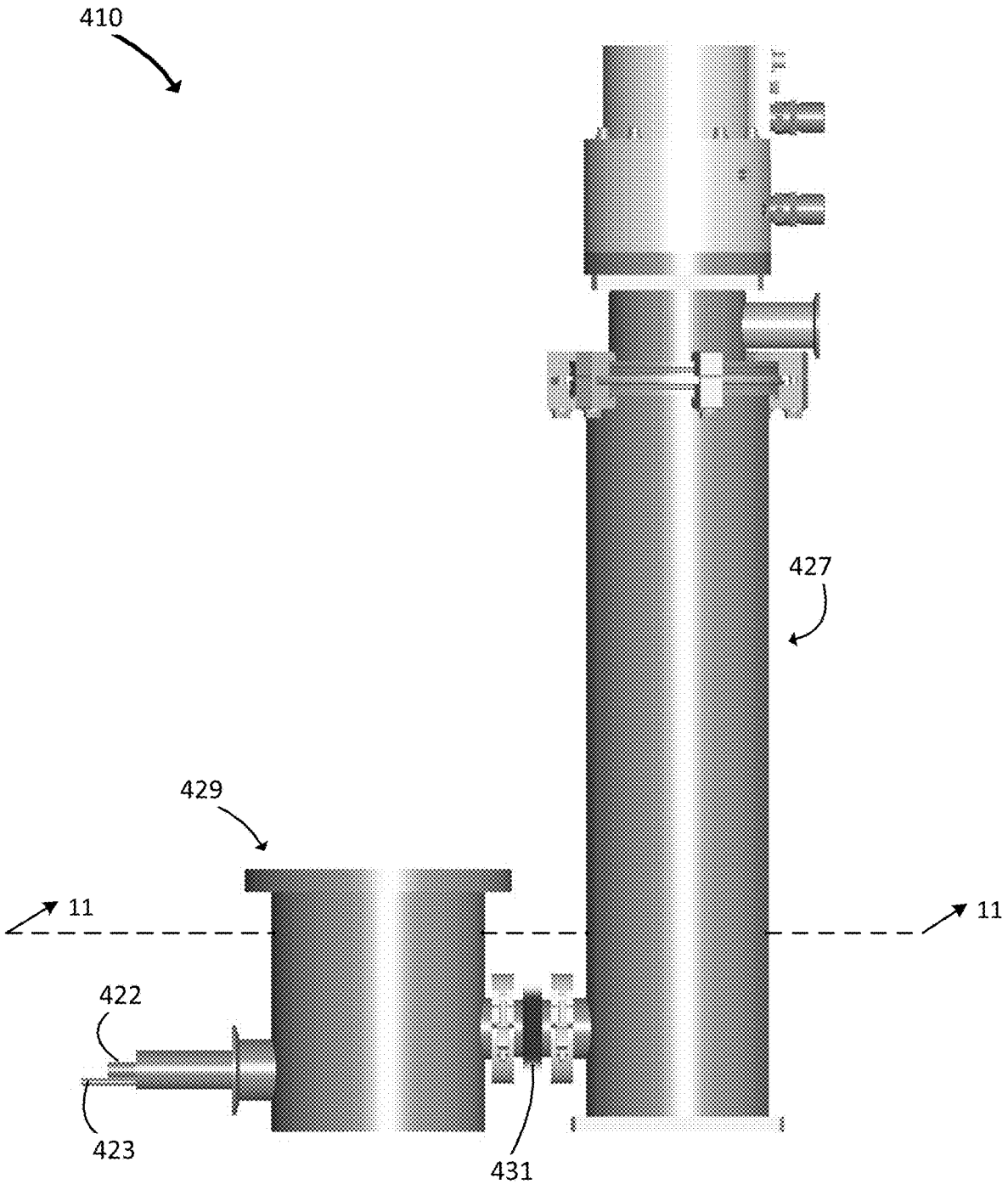
FIG. 10 is a side elevational view of a third exemplary embodiment of a cryocooling system.
Figure 11:
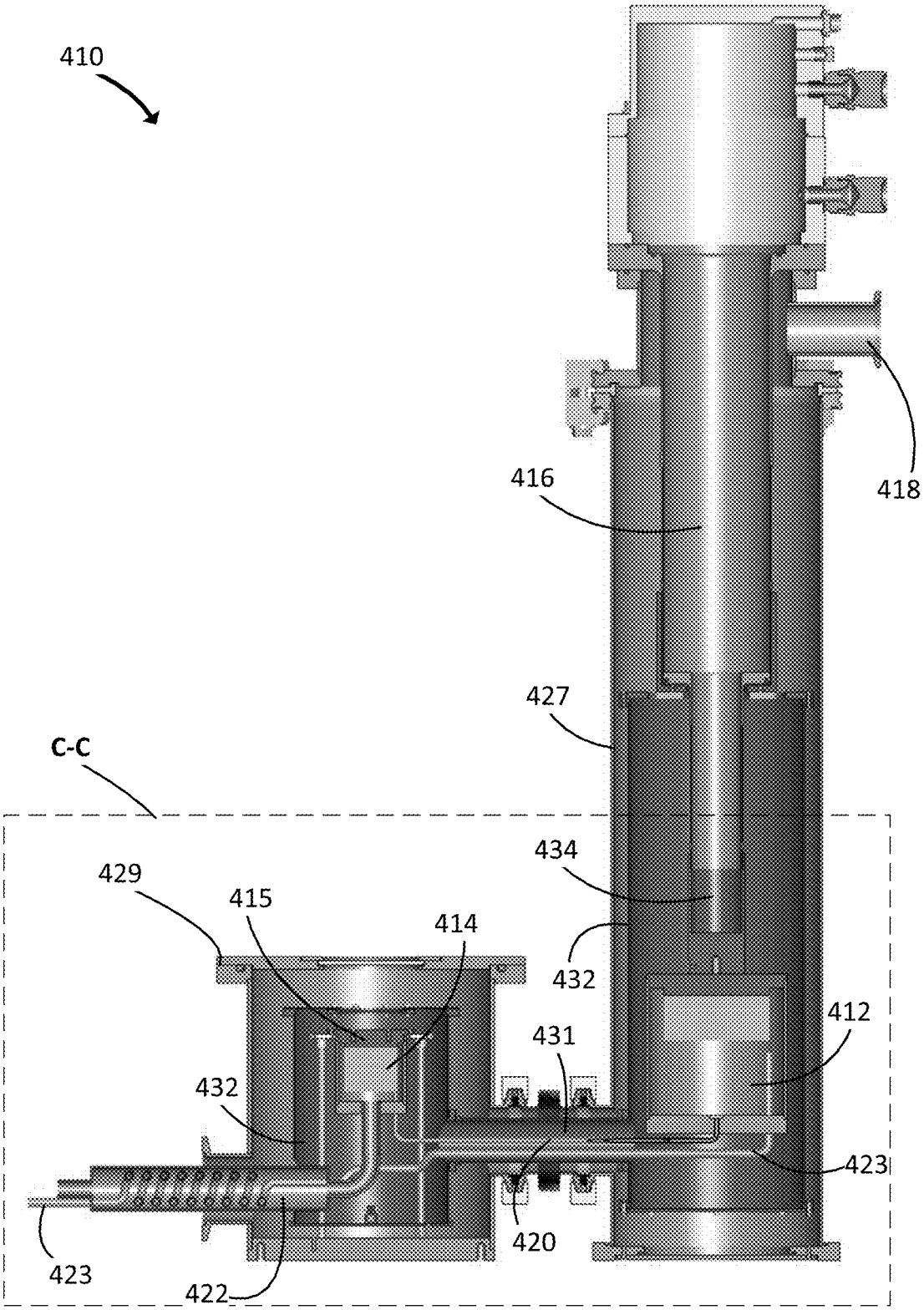
FIG. 11 is a sectional view taken along line 11-11 of FIG. 10.
Figure 12:
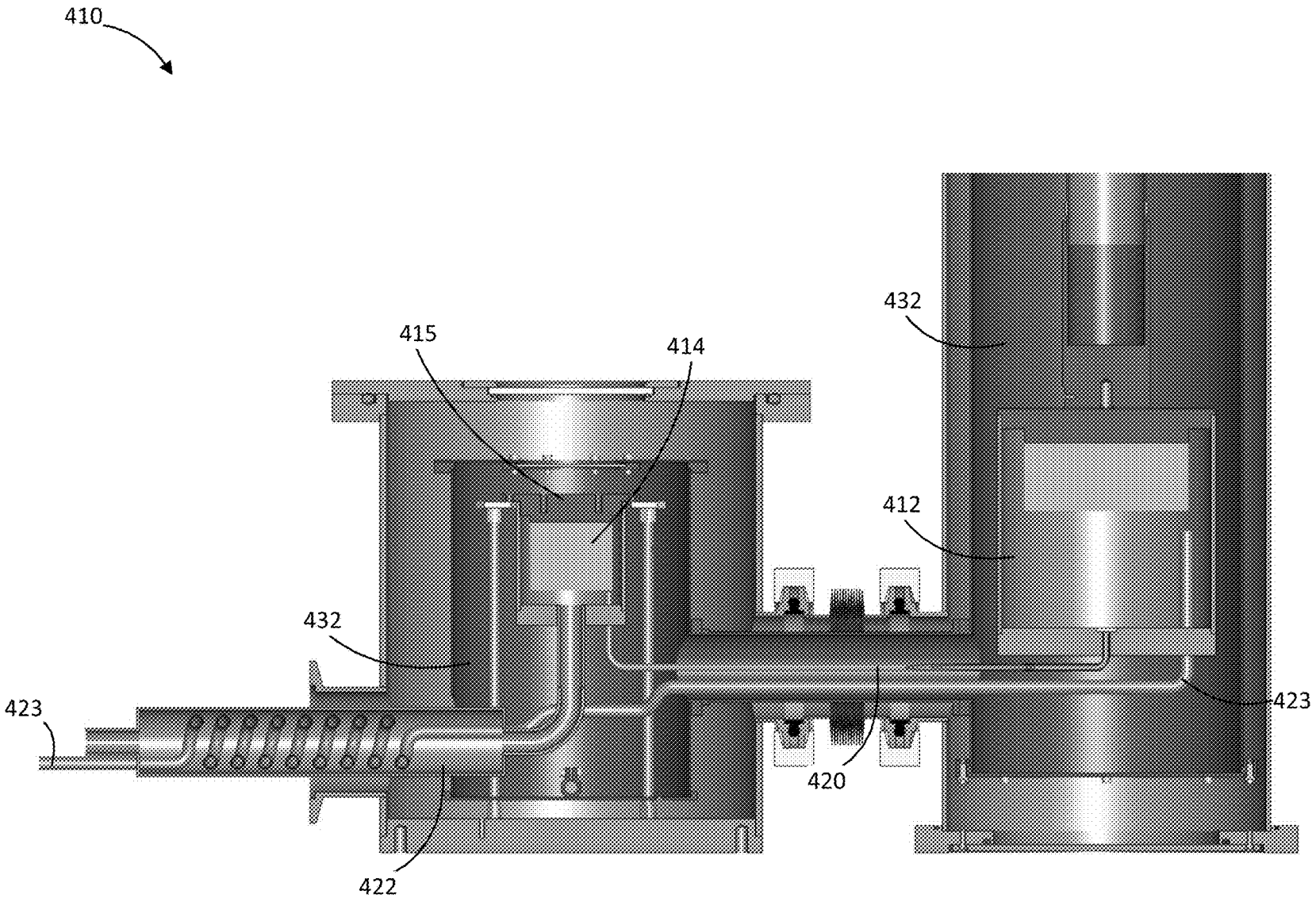
FIG. 12 is an enlarged partial view of area C-C of FIG. 11.

FIGS. 10-12 illustrate a third embodiment of a cryocooling system 410 configured to perform the cryocooling method 100 shown in FIG. 2. The cryocooling system 410 is similar to the cryocooling system 310 shown in FIGS. 7-9, except that the tubular shroud 431 is shorter than its counterpart shown in FIGS. 7-9. This embodiment conserves space while maintaining the advantages of having a sample chamber 414 located outside of the vapor environment of the sample well 412. The cryocooling system 410 also includes a return gas tube 423 that runs from the vacuum port 424 through the sample chamber shroud 429, the tubular shroud 431, and into the sample well 412. The return gas tube 423 allows exhausted gas that was once pumped out of the sample chamber 414 via the vacuum tube 422 to be fed back into the sample well 412 as part of a recycling system. The return gas tube 423 can also operate as the path through which cryocooling gas is initially introduced to the sample well 412 and the sample chamber 414.

Multiple variations of the above-described embodiments can be made without departing from the present invention. For instance, in one embodiment of the cryocooling method 100 described above, the clean out step 102 occurs by pumping air out of the cryocooling system 10 through the vacuum tube 22 and the vacuum port 24 while cryocooling gas is introduced to the sample well 12 via the gas inlet valve 18. In an alternative embodiment, the clean out step 102 can pump air out of the gas inlet valve 18 while the cryocooling gas is introduced to the sample chamber 14 via the vacuum tube 22.

In one embodiment of either the cryocooling system 310 shown in FIGS. 7-9 or the cryocooling system 410 shown in FIGS. 10-12, the sample to be cryocooled may be placed within the sample chamber 314, 414, rather than on top of the sample plate 315, 415, to provide a vapor environment instead of a vacuum environment. In another embodiment, the sample plate 315, 415 may be placed at the bottom of the sample chamber 314, 414, thereby making greater contact with the cooler helium-4 that has fallen toward the bottom of the sample chamber 314, 414. In one embodiment of the cryocooling system 210 shown in FIGS. 3-5, the sample chamber 214 may sit at the bottom of the sample well 212, which can be made of copper and act as a cold plate, allowing the sample to be placed in a vacuum in a manner similar to those of the cryocooling systems 310, 410 of FIGS. 7-12.

In embodiments where a controller 25 is used, a heater (not shown) may be added to the cryocooling system 10 to help control the temperature and pressure inside the sample well 12 and sample chamber 14.

The disclosure is further illustrated by the following examples, which are not to be construed as imposing limitations on the scope of the present invention. Various other aspects, embodiments, modifications, and equivalents thereof which, after reading the description herein, may suggest themselves to one of ordinary skill in the art without departing from the spirit of the present invention.

Example 1

Figure 13:
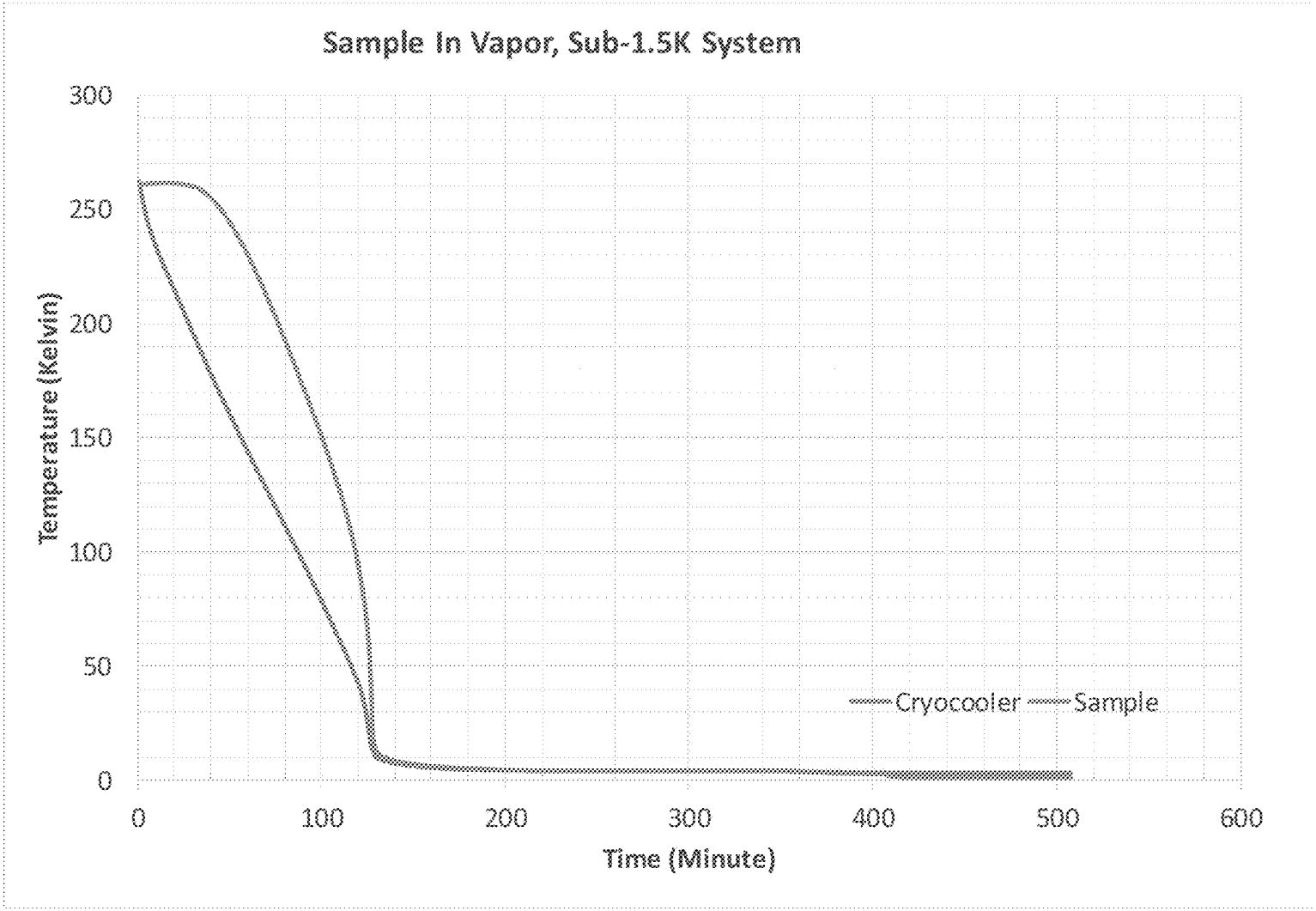
FIG. 13 is a chart showing the results of a sample test of the cryocooling system shown in FIGS. 3-5, which is described in detail in Example 1 further below.

A sample test was conducted using the cryocooling system 210 shown in FIGS. 3-5. Charts showing the results of this second test are exhibited in FIGS. 13 and 14. In this test, the impedance tube 220 had a 28.35 inch length, a 0.125 inch outer diameter, and a 0.016 inch wall thickness, while the vacuum tube 222 had a 26.50 inch length, a 0.750 inch outer diameter, and a 0.016 inch wall thickness.

After purging and filling the sample well 212 and sample chamber 214 with helium-4, the cryocooler 216 was activated. Temperature gauges were connected to the cryocooler 216 and the sample chamber 214. At minute 0, the temperature of the cryocooler 216 was 262.16 K while the temperature inside the sample chamber 214 was 260.53 K. At this time, the vacuum port 224 was closed while the gas inlet valve 218 was left open to allow helium-4 to continue to enter the cryocooling system 210.

Temperature readings were taken every minute. The cryocooler 216 temperature sharply fell to 10.98 K from minute 0 to minute 129. The temperature of the sample chamber 214 remained steadily between 260.50 K and 261.05 K from minute 0 to minute 25, then sharply declined to 15.028 K from minute 26 to minute 129. At minute 130 (i.e., after just over 2 hours), the rate of change in temperature drop for both the cryocooler 216 and the sample chamber 214 took a turn, and the temperatures for both the cryocooler 216 and the sample chamber 214 began falling much less dramatically. Helium-4 continued to enter the sample well 212 and sample chamber 216 of the cryocooling system 210 during this time.

The temperature of the cryocooler 216 fell slowly from 9.805 K at minute 130 to 3.924 K at minute 222, while the temperature of the sample well 214 fell from 13.149 K at minute 130 to 4.335 K at minute 227. From these two points until minute 352, the temperatures of the cryocooler 216 and the sample chamber 214 remained steady, between 3.922 K and 3.935 K for the cryocooler 216 and 4.323 K and 4.335 K for the sample chamber 214. During this time (i.e., 125 minutes, or approximately 2 hours), helium-4 continued to collect in the sample well 212 and sample chamber 214, some of which was in liquid form.

Figure 14:
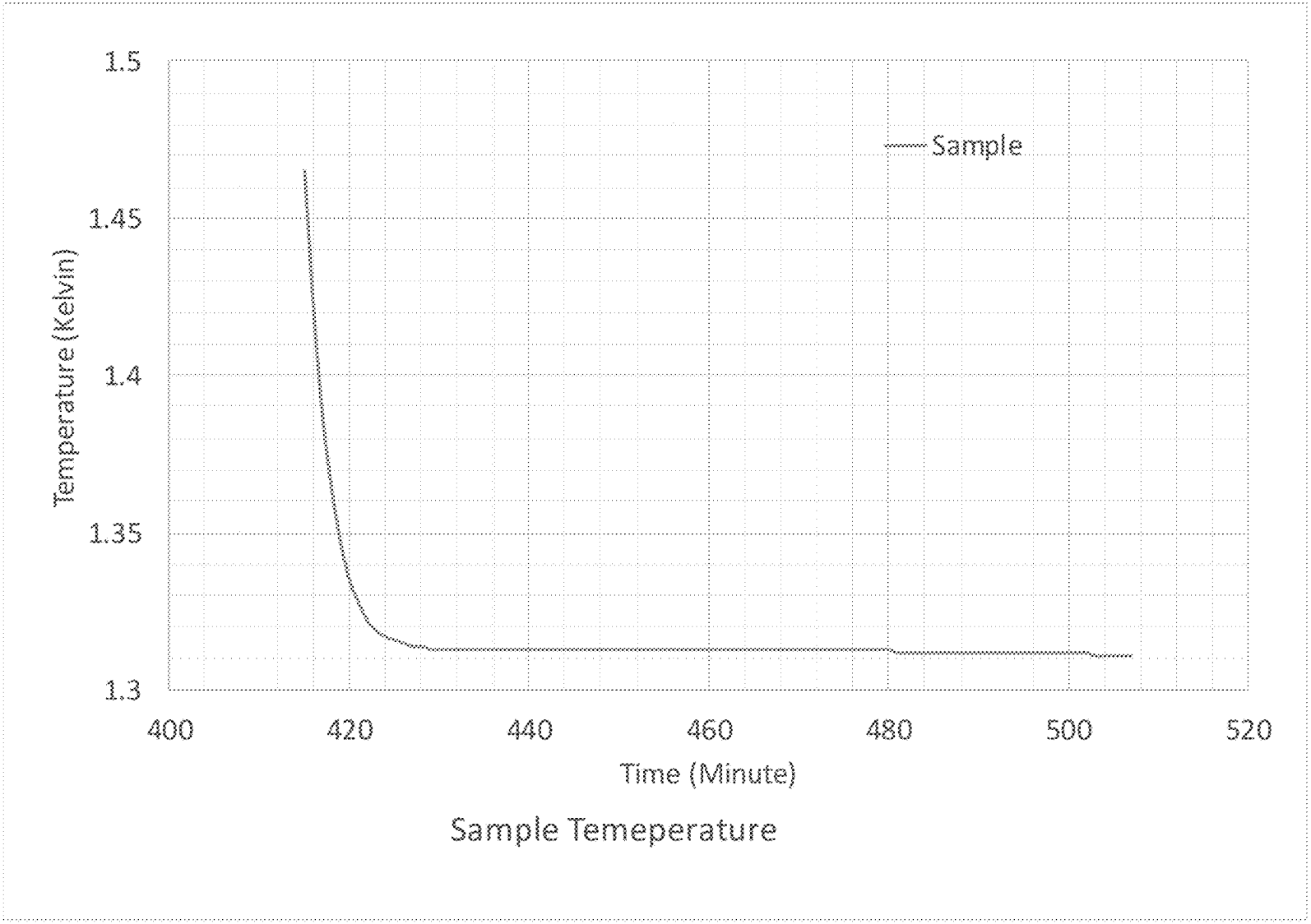
FIG. 14 is a chart focusing on a portion of the results shown in FIG. 13.

At minute 352, the gas inlet valve 218 was closed. The temperatures of the cryocooler 216 and the sample chamber 214 began to drop steadily from 3.935 K and 4.331 K, respectively, to 3.223 K and 3.006 K, respectively, at minute 406. At minute 406, the vacuum port was opened and the attached vacuum pump was activated, drawing helium-4 out of the sample chamber 214 through the vacuum tube 222. As shown in FIG. 14, the temperature of the sample chamber 214 sharply dropped from 3.006 K at minute 406 to 1.465 K at minute 415, to 1.387 K at minute 417, and to 1.319 K at minute 423. The temperature of sample chamber 214 then slowly dropped to 1.317 K at minute 424, 1.316 K at minute 425, 1.315 K at minute 426, 1.314 K at minute 427, 1.313 K at minute 429, 1.312 K at minute 481, and 1.311 K at minute 503. Readings ceased being recorded at minute 507, at which the temperature in the sample chamber 214 was still 1.311 K. The temperature of the cryocooler remained stably between 2.997 K and 3.087 K from minute 408 to minute 507.

To summarize, after the vacuum pump was activated, the temperature of the sample chamber remained under 1.5 K for 92 minutes (i.e., minutes 415 to 507), under 1.4 K for 90 minutes (minutes 417 to 507), and under 1.319 K for 84 minutes (i.e., minutes 423 to 507).

Example 2

A second test was conducted using the cryocooling system 210 shown in FIGS. 3-5. In this test, the impedance tube 220 had a 37 inch length, a 0.188 inch outer diameter, and a 0.020 inch wall thickness, while the vacuum tube 222 had a 26.25 inch length, a 1.000 inch outer diameter, and a 0.016 inch wall thickness.

After purging and filling the sample well 212 and sample chamber 214 with helium-4, the cryocooler 216 was activated. Temperature gauges were connected to the cryocooler 216 and the sample chamber 214. At minute 0, the temperature of the cryocooler 416 was 292.51 K while the temperature inside the sample chamber 214 was 295.53 K. At this time, the vacuum port 224 was closed while the gas inlet valve 218 was left open to allow helium-4 to continue to enter the cryocooling system 210.

Temperature readings were taken every minute. The temperature of the cryocooler 216 began falling from 292.51 K at minute 0 to 10.095 K at minute 161. The temperature of the sample chamber 214 remained steadily between 295.54 K and 295.02 K from minute 0 to minute 24, then began falling more quickly to 270.98 K at minute 72, then sharply declining to 16.122 K at minute 161. At minute 161, the rate of change in temperature drop for both the cryocooler 216 and the sample chamber 414 took a turn and slowly declined to 7.889 K and 10.418 K, respectively, at minute 170. After a 17-minute period of slowly climbing to 8.276 K and 11.194 K, respectively (at minute 187), the temperatures for both the cryocooler 216 and the sample chamber 214 began falling again, reaching 3.944 K and 4.369 K, respectively, at minute 250.

From minute 250 to minute 423, the temperature of the cryocooler 216 fluctuated between 3.936 K and 3.966 K while the temperature of the sample chamber 214 fluctuated between 4.337 K and 4.374 K. During this time (i.e., 173 minutes, or just under 3 hours), helium-4 continued to enter the sample well 212 and sample chamber 216 of the cryocooling system 210 and began collecting inside the sample well 212 and sample chamber 214, some of which was in liquid form.

At minute 423, the gas inlet valve 218 was closed. The temperatures of the cryocooler 216 and the sample chamber 214 began to drop from 3.963 K and 4.369 K, respectively, to 3.395 K and 3.291 K, respectively, at minute 489. At minute 489, the vacuum port was opened and the attached vacuum pump was activated, drawing helium-4 out of the sample chamber 214 through the vacuum tube 222. The temperature of the sample chamber 214 sharply dropped from 3.291 K at minute 489 to 1.498 K at minute 497, to 1.398 K at minute 503, and to 1.391 K at minute 509.

The temperature of sample chamber 214 then slowly dropped over the course of 198 minutes from 1.391 K to 1.356 K. During this time, the sample chamber 214 had a temperature of 1.391 from minute 509 to 512, 1.390 K from minute 513 to 518, and 1.389 K from minute 519 to 526. The temperature of the sample chamber 214 then began dropping 0.001 K every 9-10 minutes until minute 636, at which its temperature was 1.377 K. The temperature of the sample chamber 214 remained 1.377 K from minute 636 to 651 before sharply dropping to 1.361 K at minute 657, held at 1.361 K until minute 661, then steadily declined 0.001 K every 8-12 minutes until data ceased being taken at minute 707. The temperature of the cryocooler remained stably between 3.100 K and 3.225 K from minute 490 to minute 707.

To summarize, after the vacuum pump was activated, the temperature of the sample chamber remained under 1.5 K for 210 minutes (i.e., minutes 497 to 707), under 1.4 K for 204 minutes (minutes 503 to 707), and under 1.391 K for 192 minutes (i.e., minutes 509 to 707).

All examples and conditional language recited herein are intended for pedagogical purposes to aid the reader in understanding the principles of the present invention and the concepts contributed by the inventor in furthering the art. As such, they are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It is to be understood that the embodiments described herein are merely exemplary and that a person skilled in the art may make many variations and modifications without departing from the spirit and scope of the invention. All such variations and modifications are intended to be included within the scope of the invention, as defined by the following claims.

We claim:

1. A method comprising:

(a) providing a cryocooling system including a sample well, a sample chamber, an impedance tube in fluid-flow communication with the sample well and the sample chamber, and a vacuum tube in fluid-flow communication with the sample chamber, the impedance tube having a hydraulic resistance that is higher than a hydraulic resistance of the vacuum tube;

(b) purging the sample well and sample chamber of all gas except a cryocooling fluid;

(c) cooling the cryocooling fluid in the sample well and sample chamber;

(d) reducing the pressure of the cryocooling fluid in the sample chamber using a vacuum to create a pressure difference between the cryocooling fluid in the sample well and the cryocooling fluid in the sample chamber, thereby resulting in a flow of the cryocooling fluid from the sample well into the sample chamber through the impedance tube;

(e) allowing liquid phase cryocooling fluid to accumulate in the sample well prior to step (d);

(f) isolating the sample well and sample chamber from a cryocooling fluid supply prior to step (d); and (g) performing step (d) until the cryocooling fluid in the sample chamber attains a temperature at or below 3.5 Kelvin.

2. The method of claim 1, further comprising (h) supplying the sample well and sample chamber with the cryocooling fluid from the cryocooling fluid supply prior to step (f).

3. The method of claim 1, wherein step (d) further includes withdrawing cryocooling fluid from the sample chamber through the vacuum tube.

4. The method of claim 1, wherein a ratio of the hydraulic resistance of the impedance tube to the hydraulic resistance of the vacuum tube is at least 40:1.

5. The method of claim 4, wherein the ratio of the hydraulic resistance of the impedance tube to the hydraulic resistance of the vacuum tube is between 40:1 and 50:1.

6. The method of claim 1, further comprising:

(i) inserting a sample to be cooled in the sample chamber prior to performing any of steps (a) through (g).

7. The method of claim 1, wherein step (g) includes performing step (d) until the cryocooling fluid in the sample chamber attains a temperature at or below 1.50 Kelvin.

8. The method of claim 6, wherein the cryocooling fluid in the sample chamber is held at a temperature at or below 1.50 Kelvin for at least two hours.

9. The method of claim 7, wherein the cryocooling fluid in the sample chamber is held at a temperature at or below 1.50 Kelvin for at least three hours.

10. The method of claim 1, further comprising:

(j) feeding exhausted cryocooling fluid into the sample well via a return gas tube, wherein the exhausted cryocooling fluid comprises cryocooling fluid that was removed from the sample chamber during step (d).

11. The method of claim 1, wherein the cryocooling fluid flowing from the sample well to the sample chamber during step (d) is gas phase when it reaches the sample chamber.

12. The method of claim 1, wherein step (a) further comprises providing the vacuum tube having an outer surface and the impedance tube that is coiled around the outer surface of the vacuum tube.

13. The method of claim 1, wherein step (a) further comprises providing the sample chamber nested within the sample well.

* * * * *